United States Patent [19]

Estadella

[11] Patent Number: 4,587,676

[45] Date of Patent: May 13, 1986

[54] COLLAPSIBLE PROTECTING HELMET

[76] Inventor: María A. S. Estadella, Bajada de la Gloria, 47, Barcelona, Spain

[21] Appl. No.: 568,803

[22] Filed: Jan. 6, 1984

[30] Foreign Application Priority Data

Jan. 13, 1983 [ES] Spain ..... 269734

[51] Int. Cl.[4] ..... A42B 3/02

[52] U.S. Cl. ..... 2/424; 2/209.1

[58] Field of Search ..... 2/410, 424, 10, 6, 205, 2/209.1, 411, 412, 413, 414

[56] References Cited

U.S. PATENT DOCUMENTS

| | | | |
|---|---|---|---|
| 2,888,681 | 6/1959 | Stuart et al. | 2/6 |
| 3,987,495 | 10/1976 | Holley | 2/410 |
| 3,991,422 | 11/1976 | Saotome et al. | 2/410 |
| 4,024,587 | 5/1977 | Barford | 2/424 |
| 4,209,858 | 7/1980 | Coenen | 2/6 X |

FOREIGN PATENT DOCUMENTS

| | | |
|---|---|---|
| 0071327 | Fed. Rep. of Germany | 2/6 |

*Primary Examiner*—Peter Nerbun

*Attorney, Agent, or Firm*—Michael J. Striker

[57] ABSTRACT

A collapsible protecting helmet with inside stuffing and closing and fastening, including two supplemental portions, one top portion and one lower portion, both of these portions are mutually joined at two pivot points and make up the collapsible protecting helmet, engagement component to secure the engaged position the two top and lower portions being dimensioned such as to allow both portions to rotate about the rotating points and engage one inside the other in a folded position.

12 Claims, 12 Drawing Figures

COLLAPSIBLE PROTECTING HELMET

BACKGROUND OF THE INVENTION

The present invention relates to a collapsible protecting helmet. Although the helmet made up according to the innovations provided by the invention can be used in any activity whatsoever involving a risk of head injuries, in principle the helmet is more particularly thought of for use by motorcycle and motorcar drivers.

Protecting helmets have experienced, since their early beginning, very major changes which have mainly been driven or caused by two fundamental aims: the insertion of new constructive techniques and/or new materials and fulfillment of stricter safety specifications which were progressively set up at the same time as the experience has provided specific empirical data and general statistics of incalculable utility. Thus, with the course of the years, significant innovations have been incorporated; such as, the manufacture of the outside cover utilizing fiberglass layers reinforced resins; the use of fireproof paints; the integral structure; the multilayer and non-flammable visors for immediate starting-up, if dirty; the intermediate anticollision layer; the inside stuffings of a high collision absorption rate; and the insertion of electronic means for communications, etc.

However, there is a disadvantage in all the aforementioned helmet, above all in the integral helmet of widely universal use nowadays, since although it can be qualified as secondary as related with the fundamental features a helmet has to meet together, still it remains an effective and troublesome drawback: this is its extreme bulkiness, which causes a great discomfort to the user when the helmet is carried about while it is not used on the head.

SUMMARY OF THE INVENTION

The present invention relates to a collapsible helmet that overcomes the above explained drawback.

In accordance with the invention, the helmet can have together in its structure all the features required as related to any materials, components, visor, inside stuffing, resistant supplements and anything else, since the features of the new helmet do not depend on these means and are therefore independent thereof. Admittedly then, for the most part of the known helmets the new features could easily be incorporated, according to the invention, with the purpose being to make them collapsible.

The protecting helmet according to the present invention which can have a visor, proper inside stuffing means and safety and fastening supplements is essentially characterized by the fact that it comprises two supplemental portions, a top portion and a lower portion, which define together the integral shape of the helmet and can reciprocally be engaged through the line which extends parallel to a line that defines the bottom perimeter of the helmet or near the line and having the two portions mutually linked together by two laterally pivoted rotating points being mutually opposed and coaxial, and containing engagement means to secure the engaging position, and having the portions being so dimensioned that a full folding position is obtained by the rotation of the top portion around the two rotating points while the receiving inside the lower portion is allowed and the rotating portion is thereby total or partially concealed.

The helmet as hereinbefore disclosed provides therefore the most advantageous way of enabling when not in use, the helmet to be folded so as to take a size equivalent to about half the size taken when being used.

The visor rotation can be set up, either independently by advantage of the rotating points themselves of the two portions that essentially make up the protecting helmet.

With regards to the engagement of securing the unfolded position, i.e. the used position of the two helmet positions, any effective engagement whatever capable of providing to the unit the required safety and reliability specifications can be utilized. However, it is advisable that its position and structure allow for easy handling of the opening and closing operations and therefore its external arrangement is therefore highly advantageous in this case. It cannot be obviously ruled out that an engagement internally located is possible, since properly combining it with the stuffing members or equipment components, such engagement can be located at the helmet inside surface.

The incorporation of two or more engagements can also be provided, in this case the clamping stresses would be better spread out.

With regards to the engagement between the top and lower portions, sturdy rigidity can be secured by means of supplemental projections such as a groove and a tongue, and other types of joints.

In the drawing sheets attached to the present specification is shown by way of a non-exhaustive example only, a collapsible protecting helmet made up in accordance with the characteristics of the invention.

DETAILED DESCRIPTION OF THE PREFERRED EMBODIMENTS

Figure 1:
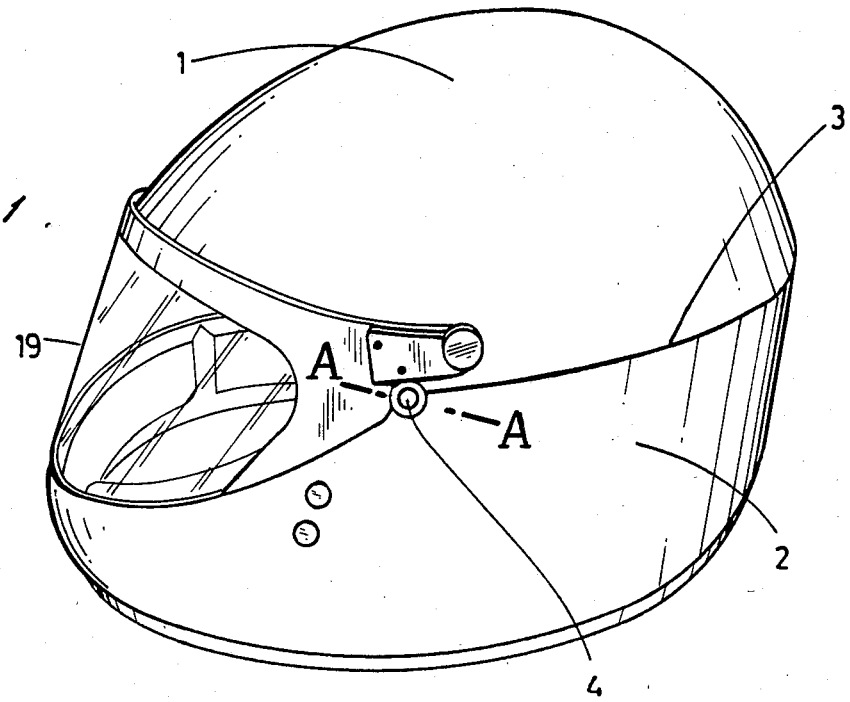
FIG. 1 is a perspective view of the helmet of the present invention in the unfolded position.

As can be seen from the drawing, the helmet of the present invention is essentially made up of two portions, a top portion 1 and a lower portion 2.

Figure 2:
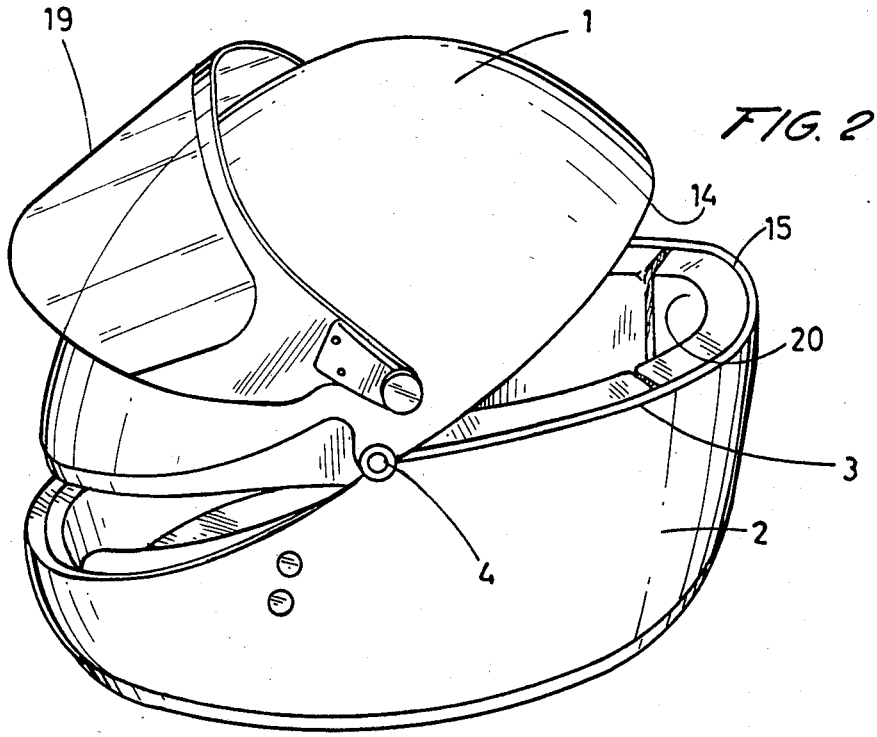
FIG. 2 is a perspective view of the helmet of FIG. 1, shown in the intermediate stage of the folding operation (or unfolding operation, according to the direction of the motion being considered.
Figure 3:
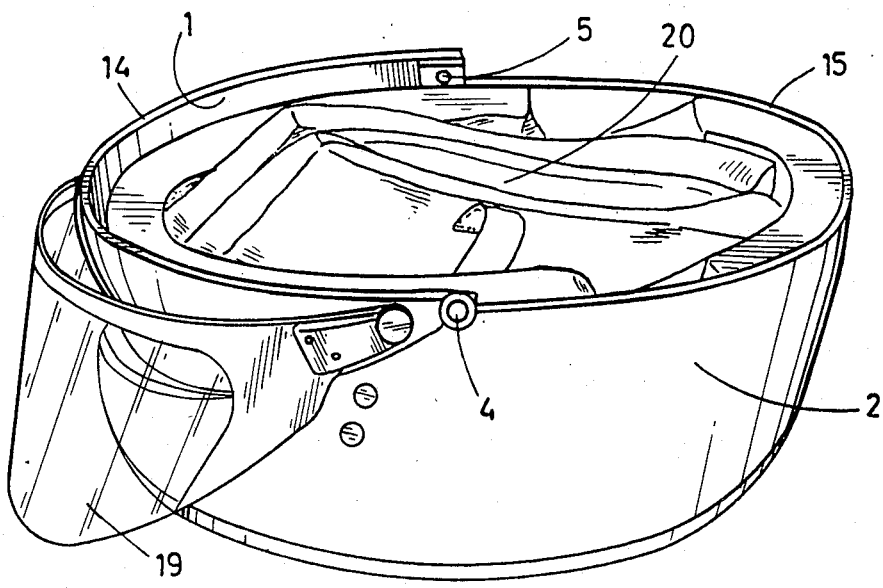
FIG. 3 is a perspective view showing the helmet of FIG. 1 in the fully collapsible position.
Figure 5:
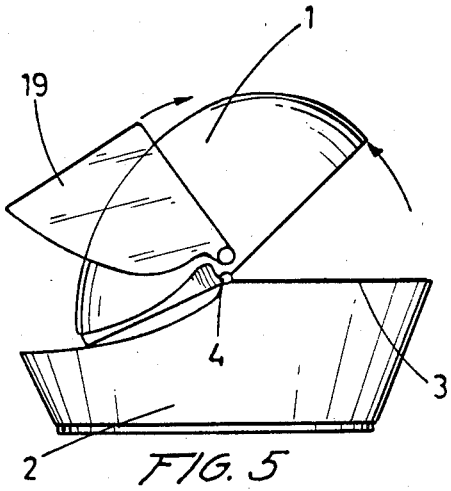
FIG. 5 is a side view of the helmet of FIG. 2 in the intermediate position between the folded and the unfolded positions.
Figure 6:
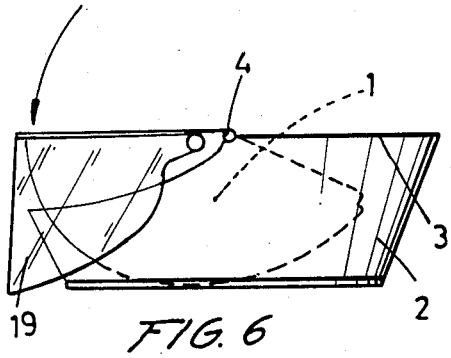
FIG. 6 is a side view of the helmet of FIG. 3 in the fully collapsed position.

Both portions 1 and 2 are capable of being mutually engaged along a line 3 which extends substantially parallel to a line that defines the bottom perimeter of the helmet. The portions 1 and 2 are mutually joined together by rotating points 4 and 5, which are reciprocally opposed and laterally arranged. Since these rotating points 4 and 5 are coaxial they enable therefore a rotation of the top portion 1 as can more specifically seen in FIGS. 2 and 5. When the rotation is completed, the top portion 1 is concealed completely in a housing defined by the inside of the lower portion 2. FIGS. 3 and 6 are particularly representative of this feature.

Figure 4:
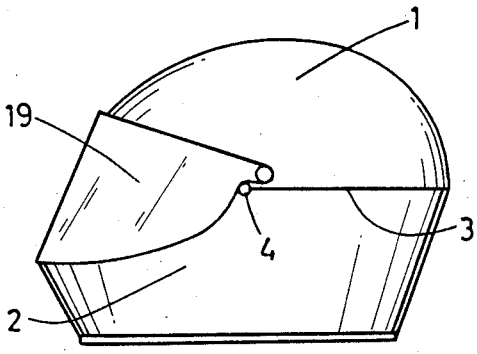
FIG. 4 is a side view of the helmet of FIG. 1 in the unfolded position.
Figure 7:
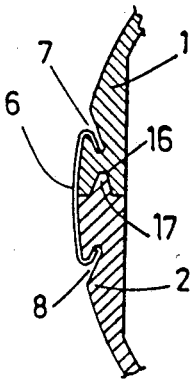
FIGS. 7 to 12 are cross-sectional views showing details of various engagements in a cross-section taken along the line AA in FIG. 1.

The engagement that secures a tight holding in the unfolded position illustrated in FIGS. 1 and 4, can be any suitable one. In FIG. 7, is shown, an example wherein a sliding hook 6 is shifted alongside pertinent channels 7 and 8 that are provided in the portions 1 and 2. The disengagement is achieved by the provision of a hollow or height reduction in any one of the cited channels. It shall be understood that these channels can also be provided at the helmet inside surface, this other embodiment is not illustrated since its understanding appears to be quite simple.

Another way of accomplishing the engagement is by means of a provision of reciprocally opposed and clasped projections that are provided with a hook. This embodiment can also be applied either externally (not shown) or internal as can be seen in FIG. 8 wherein the projections 9 and 10 and the sliding hook 11 are shown.

Figure 12:
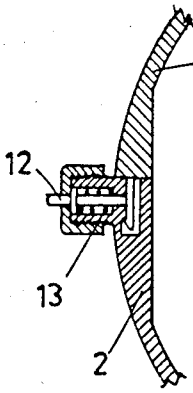

In FIG. 12, a more complex mechanical engagement than those previously disclosed is shown. In this case, the user accomplishes the fastening and closing operations by the use of a resilient engagement whose closing is achieved by a simple push and whose opening is achieved by depressing a pushbutton 12 which automatically returns to its original position by the use of a suitable spring 13.

Figure 8:
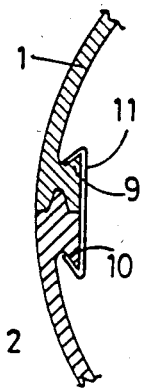
Figure 9:
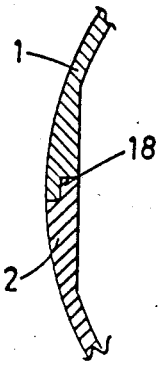
Figure 10:
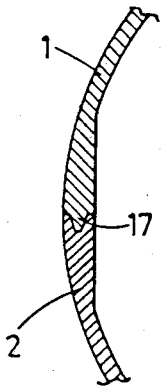
Figure 11:
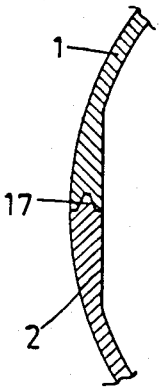

Again, in FIGS. 7 to 12 it can be seen how the engagement between opposed edges 14 and 15 of the top portion 1 and lower portion 2, respectively make up the helmet is not performed by means of smooth surfaces but instead, with great sturdy advantage, the engagement takes place by means of supplemental projections. In FIGS. 7 and 8 these projections are groove and tongue joints with box 16 and pin 17. In FIG. 9 the engagement is achieved by use of a stepped joint 18. In FIGS. 10 and 11, it is shown how the groove and tongue joint may be accomplished with the pin 17 on the top side and box 16 on the lower side. A good balance would be achieved if in the same helmet different stretches are provided alongside the opposed edges 14 and 15 so that the section of one of them meets the other as is shown in FIG. 10 and oppositely as illustrated in FIG. 11 (i.e. alternatively the pin 17 is at the top portion 1 and at the lower portion 2).

Obviously, the helmet according to the present invention may have any definite external shape which would allow the fulfillment of the previously mentioned requirements. As usual, the helmet of the present invention can be provided with visor 19 and internal stuffing 20. The stuffing 20 clearly may have the most suitable shape to enable any folding and unfolding rotations of the top portion 1.

The concept of the rotating top portion 1 is simply relative and assumes in a conventional way that the lower portion 2, being the most stable component of the unit, remains motionless during the folding and unfolding operations. However, and inversely, the lower portion 2 is rotated while the top portion 1 remains motionless or it can even be asserted that both portions 1 and 2 are rotated. It is evident then that in all the cases, an identical arrangement is achieved.

With regard to the use of the helmet, according to the present invention, obviously it can be any one of those used by conventional helmets of the previously disclosed type. That is, motoring, motorcycling, aviation, winter sports, etc. whereby it shall be understood that the helmet of the present invention can incorporate all those specific features peculiar to each case.

In conclusion, in the practical performance of the object of the present invention, any other constructive and configurative details can be varied provided the invention's own essentiality is not upset by way of modifications and changes.

I claim:

1. A collapsible protecting helmet comprising:

a body including a first portion and a second portion, said portions abutting along a first line which is substantially parallel to a line which defines the bottom perimeter of the helmet, said portions being pivotable relative to one another between an unfolded position in which they engage one another substantially in the region of said first line, and a folded position in which said first portion is at least partially concealed in said second portion;

pivot means pivotably connecting said portions to each other; and engagement means securing said first and second portion with each other in said unfolded position, said engagement means being formed as push-button operated spring-biased means.

2. The helmet as defined in claim 1, wherein said first portion is a top portion and said second portion is a bottom portion.

3. The helmet as defined in claim 1, wherein said first portion is a bottom portion and said second portion is a top portion.

4. The helmet as defined in claim 1, wherein said pivot means includes two pivoted rotating points.

5. The helmet as defined in claim 4, wherein said two pivot points are laterally disposed on the helmet and mutually opposed to and coaxial with each other.

6. The helmet as defined in claim 1, wherein said first and second portions have external surfaces, said engagement means including a resilient engagement having a biasing spring and disposed substantially at said parallel-like line of said external surfaces of said first and second portions and is push button releasable by means of said biasing spring.

7. The helmet as defined in claim 1, wherein said first and second portions have profiled edges that interlock with each other.

8. The helmet as defined in claim 7, wherein one of said profiled edges is a tongue and the other one of said profiled edges is a groove.

9. The helmet as defined in claim 1, wherein said first and second portions have profiled edges that are stepped.

10. The helmet as defined in claim 1, wherein said first and second portions have inner sides with fillets disposed substantially at said first line so as to achieve better balance.

11. The helmet as defined in claim 1, further comprising a visor, suitable internal stuffing means, safety equipment and fastening equipment.

12. The helmet as defined in claim 2, wherein said first portion engages said second portion in said folded position.

* * * * *